US008235483B2

(12) United States Patent
Kato et al.

(10) Patent No.: US 8,235,483 B2
(45) Date of Patent: Aug. 7, 2012

(54) DROPLET JETTING DEVICE

(75) Inventors: Yoshinori Kato, Kanagawa (JP); Takamichi Fujii, Kanagawa (JP); Shuhei Hoshino, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 272 days.

(21) Appl. No.: 12/713,197

(22) Filed: Feb. 26, 2010

(65) Prior Publication Data

US 2010/0245411 A1 Sep. 30, 2010

(30) Foreign Application Priority Data

Mar. 27, 2009 (JP) ..... 2009-079986

(51) Int. Cl.
*B41J 29/38* (2006.01)
*B41J 2/015* (2006.01)
*B41J 2/165* (2006.01)

(52) U.S. Cl. ..... 347/6; 347/17; 347/20; 347/23

(58) Field of Classification Search ..... None
See application file for complete search history.

(56) References Cited

U.S. PATENT DOCUMENTS

| | | | | |
|---|---|---|---|---|
| 6,428,156 | B1 * | 8/2002 | Waller et al. | 347/89 |
| 6,857,719 | B2 * | 2/2005 | Silverbrook | 347/17 |
| 2008/0204501 | A1 * | 8/2008 | Kurita et al. | 347/17 |

FOREIGN PATENT DOCUMENTS

| | | | |
|---|---|---|---|
| JP | 2003-214349 | A | 7/2003 |
| JP | 2003-286958 | A | 10/2003 |
| JP | 2005-279784 | A | 10/2005 |
| JP | 2006-272577 | A | 10/2006 |
| JP | 2006-319945 | A | 11/2006 |

* cited by examiner

*Primary Examiner* — Stephen Meier
*Assistant Examiner* — Alexander C Witkowski
(74) *Attorney, Agent, or Firm* — SOLARIS Intellectual Property Group, PLLC

(57) ABSTRACT

A droplet jetting device that includes a recording head section, a pressure sensor and a regulation pump is provided. The recording head section includes a recording head that jets droplets from nozzles and records an image at a recording medium. The pressure sensor is provided at the recording head section and senses a pressure of liquid supplied to the recording head by a main pump from a main tank. The main tank is disposed at a position away from the recording head section. The regulation pump is provided at the recording head section that is smaller in scale than the main pump and regulates pressure of the liquid such that the pressure of the liquid sensed by the pressure sensor is constant.

10 Claims, 7 Drawing Sheets

DROPLET JETTING DEVICE

CROSS-REFERENCE TO RELATED APPLICATION

This application claims priority under 35 USC 119 from Japanese Patent Application No. 2009-079986 filed on Mar. 27, 2009, the disclosure of which is incorporated by reference herein.

BACKGROUND OF THE INVENTION

1. Field of the Invention

The present invention relates to a droplet jetting device, and particularly relates to a droplet jetting device for jetting droplets from nozzles of a recording head that is provided at a recording head section of an image forming device.

2. Description of the Related Art

Droplet jetting devices are common that supply liquid to a recording head provided at a recording head section of an image forming device, jet droplets of the liquid at a recording medium from nozzles, and cause an image to be formed. Examples of such droplet jetting devices include an inkjet recording device that jets ink from nozzles of an inkjet head. An example of a droplet jetting device that jets droplets from an inkjet head of this inkjet recording device is illustrated in FIG. 8.

In a droplet jetting device 120 shown in FIG. 8, a pressure of ink in an ink chamber inside an inkjet head 64 is controlled so as to be within a predetermined range. At times of starting and finishing image formation, the pressure of ink in the ink chamber changes greatly, because consumption of ink by the inkjet head 64 starts or finishes in an instant. Even when such load variations are severe, the ink pressure must be kept to within the predetermined range.

However, there is a problem as described below in regard to a pump P1 for supplying the ink and sensors S1 and S2 for monitoring the ink pressure.

In general, a tube pump is often used for the pump P1. In such a case, given a method of intermittently drawing on a tube filled with ink to feed out the ink, ripples (variations) of pressure are large. Moreover, because pump P1 itself is very expensive, it is not possible to dispose pump P1 in a vicinity of the inkjet head 64, which is packaged at high density. Therefore, pump P1 is disposed at a position away from the inkjet head 64, and a system has been adopted in which flow resistance of the ink tubing is utilized to moderate the ripples. However, because the flow resistance between the pump P1 and the inkjet head 64 is large, there are problems in that control responsiveness is poor and it is difficult to suppress the pressure changes just after starting or finishing image formation.

In addition, depending on the images to be formed, ink consumption amounts vary between plurally provided inkjet heads 64 and modules 65. Because ink is supplied in common to the head units, it is not possible to apply respectively separate controls thereto.

As for the pressure sensors S1 and S2, because the pressure sensors S1 and S2 themselves are ordinarily very expensive, it is not possible to provide the pressure sensors S1 and S2 at each of the inkjet heads 64. Therefore, a method of detecting pressures of ink in sub-tanks 128 and 132, which are distant from the inkjet heads 64, has been adopted. However, because there is flow resistance between the sub-tanks 128 and 132 and the heads, there is a problem in that it is difficult to accurately detect pressures of ink in vicinities of the inkjet heads 64, which is essentially what needs to be detected.

A technology is known that uses micro-pumps as pumps for supplying ink. Japanese Patent Application Laid-Open (JP-A) No. 2005-279784 describes a technology that uses micro-pumps based on actuators that employ MEMS (micro-electromechanical systems) technology in micro-amount fluid jetting devices, which include inkjet printer heads. Further, a technology is known, in JP-A No. 2006-272577, in which an inkjet recording device supplies ink to a sub-ink tank with micro-pumps.

However, in the related art technologies mentioned above, simply using micro-pumps is described, which cannot deal with the problem of not knowing ink pressure in the vicinity of an inkjet head, which is essentially what needs to be detected, or the problem of it being difficult to suppress pressure changes immediately after starting or finishing image formation with good responsiveness.

SUMMARY OF THE INVENTION

An object of the present invention is to provide a droplet jetting device that both measures ink pressure in a vicinity of a recording head and enables disposition of a pump in the vicinity of the recording head and performance of accurate pressure control with good responsiveness.

An aspect of the present invention is a droplet jetting device including: a recording head section including a recording head that jets droplets from nozzles and records an image at a recording medium; a pressure sensor provided at the recording head section, the pressure sensor sensing a pressure of liquid supplied to the recording head by a main pump from a main tank, the main tank being disposed at a position away from the recording head section; and a regulation pump provided at the recording head section that is smaller in scale than the main pump, the regulation pump regulating pressure of the liquid such that the pressure of the liquid sensed by the pressure sensor is constant.

DETAILED DESCRIPTION OF THE INVENTION

Herebelow, an exemplary embodiment of the present invention is described in detail.

Figure 1:
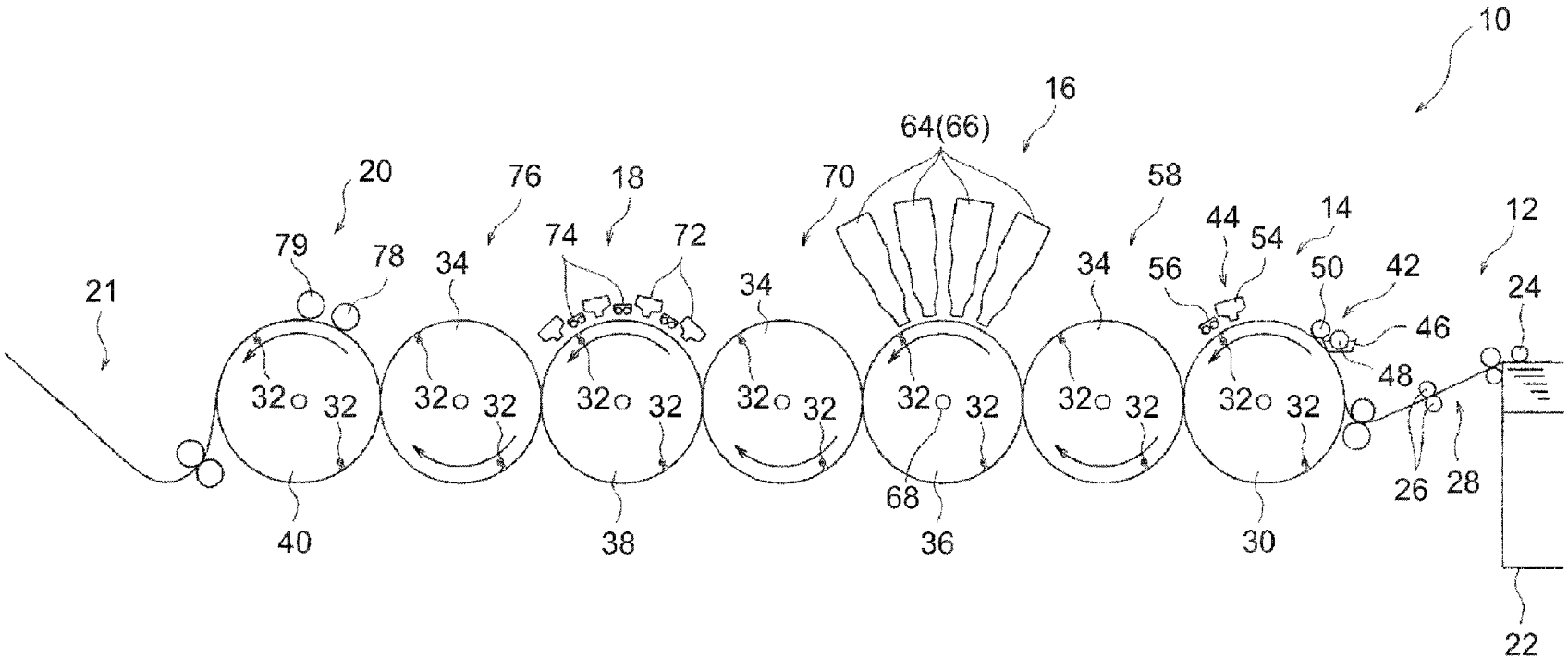
FIG. 1 is a schematic structural diagram illustrating schematics of an example of an image forming device in which droplets are jetted for forming an image by a droplet jetting device relating to an exemplary embodiment of the present invention.

Firstly, an image forming device at which droplets are jetted for forming an image, by a droplet jetting device relating to the exemplary embodiment of the present invention, will be described. FIG. 1 is a schematic structural diagram showing schematics of this example of an image forming device.

An image forming device 10 of the present exemplary embodiment is provided with: a paper supply conveyance section 12 that supplies and conveys paper, at an upstream side in a conveyance direction of a sheet of the paper that serves as a recording medium (hereinafter referred to as the paper); a processing fluid application section 14 that applies processing fluid to a recording face of the paper, along the conveyance direction of the paper at the downstream side of the paper supply conveyance section 12; an image formation section 16 that forms an image at the recording face of the paper; an ink drying section 18 that dries the image formed at the recording face; an image fixing section 20 that fixes the dried image to the paper; and an jetting section 21 that jets the paper to which the image has been fixed.

Herebelow, respective processing sections will be described.

-Paper Supply Conveyance Section-

At the paper supply conveyance section 12, a stacking section 22 in which the paper is stacked is provided, and a paper supply section 24 is provided at the paper conveyance direction downstream side (which hereinafter may be referred to as "the downstream side") of the stacking section 22. The paper supply section 24 supplies the paper stacked in the stacking section 22 one sheet at a time. The paper supplied by this paper supply section 24 is conveyed to the processing fluid application section 14 via a conveyance portion 28, which is structured by plural roller pairs 26.

-Processing Fluid Application Section-

A processing fluid application drum 30 is rotatably provided at the processing fluid application section 14. A retention member 32, which nips and retains a leading end portion of the paper, is provided at the processing fluid application drum 30. In a state in which the paper is retained at a surface of the processing fluid application drum 30 by means of the retention member 32, this paper is conveyed to the downstream side by rotation of the processing fluid application drum 30.

Similarly to the processing fluid application drum 30, retention members 32 are also provided at an intermediate conveyance drum 34, an image forming drum 36, an ink drying drum 38 and an image fixing drum 40, which are described below. The paper is passed along from upstream side drums to downstream side drums by these retention members 32.

At an upper portion of the processing fluid application drum 30, a processing fluid application device 42 and a processing fluid drying device 44 are arranged along the circumferential direction of the processing fluid application drum 30. The processing fluid is applied to the recording face of the paper by the processing fluid application device 42, and this processing fluid is dried by the processing fluid drying device 44.

Herein, the processing fluid has the effect of reacting with the ink and aggregating a colorant (pigment), and promoting separation of the colorant from a solvent. A reservoir section 46, which stores the processing fluid, is provided at the processing fluid application device 42, and a portion of a gravure roller 48 is immersed in the processing fluid.

A rubber roller 50 is disposed pressing against the gravure roller 48. The rubber roller 50 touches against the recording face (front face) side of the paper and applies the processing fluid thereto. A squeegee also touches against the gravure roller 48 and controls processing fluid application amounts that are applied to the recording face of the paper.

Meanwhile, at the processing fluid drying device 44, a hot air nozzle 54 and an infrared heater 56 (hereinafter referred to as the IR heater 56) are disposed close to the surface of the processing fluid application drum 30. A solvent such as water or the like in the processing fluid is evaporated by the hot air nozzle 54 and IR heater 56, and a solid or thin-film processing fluid layer is formed at the recording face side of the paper. The processing fluid is formed into a thin layer by the processing fluid drying process. Hence, at the image formation section 16, dots which are impacting ink drops come into contact with the recording face and provide a required dot diameter, and it is easy to obtain the action of reacting with the thin film of processing fluid, coagulating the colorant and solidifying at the paper surface.

Hence, the paper at which processing fluid has been applied to and dried at the recording face by the processing fluid application section 14 is conveyed to an intermediate conveyance section 58 that is provided between the processing fluid application section 14 and the image formation section 16.

-Intermediate Conveyance Section-

At the intermediate conveyance section 58, the intermediate conveyance drum 34 is rotatably provided, the paper is retained at the surface of the intermediate conveyance drum 34 by means of the retention member 32 that is provided at the intermediate conveyance drum 34, and the paper is conveyed to the downstream side by rotation of the intermediate conveyance drum 34. Herein, an intermediate conveyance section 70 and an intermediate conveyance section 76 have substantially the same structures as the intermediate conveyance section 58, so will not be described in detail.

-Image Formation Section-

At the image formation section 16, the image forming drum 36 is rotatably provided, the paper is retained at the surface of the image forming drum 36 by means of the retention member 32 that is provided at the image forming drum 36, and the paper is conveyed to the downstream side by rotation of the image forming drum 36.

At an upper portion of the image forming drum 36, head units 66 are disposed close to the surface of the image forming drum 36. The head units 66 are the droplet jetting device of the present exemplary embodiment and are structured with single pass-system inkjet heads 64. In these head units 66, inkjet heads 64 at least for the basic colors YMCK are arranged along the circumferential direction of the image forming drum 36. Images of the respective colors are formed by ink being jetted (impacting droplets) from nozzles onto the processing fluid layer that has been formed at the recording face of the paper by the processing fluid application section 14. A droplet jetting device 100 of the present exemplary embodiment, with which each inkjet head 64 is equipped, will be described later.

The processing fluid provides an effect of aggregating colorant and latex particles dispersed in the ink with the processing fluid, to form aggregate bodies with which colorant running on the paper and the like does not occur. As an example of a reaction between the ink and the processing fluid, a mechanism of disrupting pigment dispersion and causing aggregation by including acid in the processing fluid and lowering pH is used, and thus exudation of colorants, color mixing between inks of the respective colors, jet droplet interference due to liquid mixing when the ink droplets impact, and the like are avoided.

By jetting the droplets synchronously with an encoder that detects rotation speeds, which is provided at the image forming drum 36, each inkjet head 64 may set impact positions with high accuracy. In addition, the inkjet head 64 may reduce impact droplet irregularities regardless of vibrations of the image forming drum 36, precision of a rotation axle 68, drum surface speeds and the like.

Herein, the head units 66 are movable away from the upper portion of the image forming drum 36. Maintenance operations, such as nozzle face cleaning of the inkjet heads 64, removal of viscous ink and the like are implemented by moving the head units 66 away from the upper portion of the image forming drum 36.

The paper on whose recording face the image has been formed is conveyed by rotation of the image forming drum 36 to the ink drying section 18, via the intermediate conveyance section 70 provided between the image formation section 16 and the ink drying section 18.

-Ink Drying Section-

The ink drying drum 38 is rotatably provided at the ink drying section 18. At an upper portion of the ink drying drum 38, hot air nozzles 72 and infrared (IR) heaters 74 are plurally disposed close to a surface of the ink drying section.

In the present exemplary embodiment, as an example, the hot air nozzles 72 are disposed at an upstream side and at a downstream side, and the individual IR heaters 74 are orthogonally disposed in rows parallel with the hot air nozzles 72. This is not limiting; for example, the IR heaters 74 may be numerously disposed at the upstream side and heat energy greatly irradiated at the upstream side to raise a temperature of moisture while the hot air nozzles 72 are numerously disposed at the downstream side so as to blow away saturated water vapor.

In the present exemplary embodiment, the hot air nozzles 72 are disposed to be inclined with an angle of blowing of hot wind toward the trailing end of the paper. As a result, the flow of hot wind from the hot air nozzles 72 may be concentrated in one direction. Moreover, the paper may be pushed against the ink drying drum 38 and the state of retention of the paper at the surface of the ink drying drum 38 may be maintained.

Solvent on the paper that has been separated by the colorant aggregation action at the image formation section is dried by the hot wind from the hot air nozzles 72 and the IR heaters 74, and a thin-film image layer is formed.

The paper at whose recording face the image has been dried is conveyed by rotation of the ink drying drum 38 to the image fixing section 20, via the intermediate conveyance section 76 provided between the ink drying section and the image fixing section 20.

-Image Fixing Section-

The image fixing drum 40 is rotatably provided in the image fixing section 20. In the image fixing section 20, the latex particles in the thin image layer that was formed on the ink drying drum 38 are heated and pressured, and fused, and the image fixing section 20 has the function of solid-fixing onto the paper.

At an upper portion of the image fixing drum 40, a heating roller 78 is disposed close to the surface of the image fixing drum 40. For the heating roller 78, a halogen lamp is incorporated inside a metal pipe with good thermal conductivity, of aluminium or the like. Heat energy to at least the glass transition temperature Tg of the latex is applied by the heating roller 78. As a result, the latex particles fuse, and are pressed into irregularities on the paper and fixed. In addition, irregularities in the recording face may be leveled and glossiness provided.

A fixing roller 79 is provided at the downstream side of the heating roller 78. The fixing roller 79 is disposed in a state abutting against the surface of the image fixing drum 40, so as to provide nipping force between the fixing roller 79 and the image fixing drum 40. Accordingly, at least one of the fixing roller 79 and the image fixing drum 40 has a resilient layer at the surface thereof and a structure is formed that has a uniform nipping width with regard to the paper.

The paper to whose recording face the image has been fixed by the steps described above is conveyed to the jetting section 21 provided at the downstream side of the image fixing section 20, by rotation of the image fixing drum 40.

In the present exemplary embodiment, the image fixing section 20 has been described. However, it would be sufficient for the image formed on the recording face to be dried and fixed by the ink drying section 18. Accordingly, a structure that is not provided with the image fixing section 20 is also possible.

Figure 2:
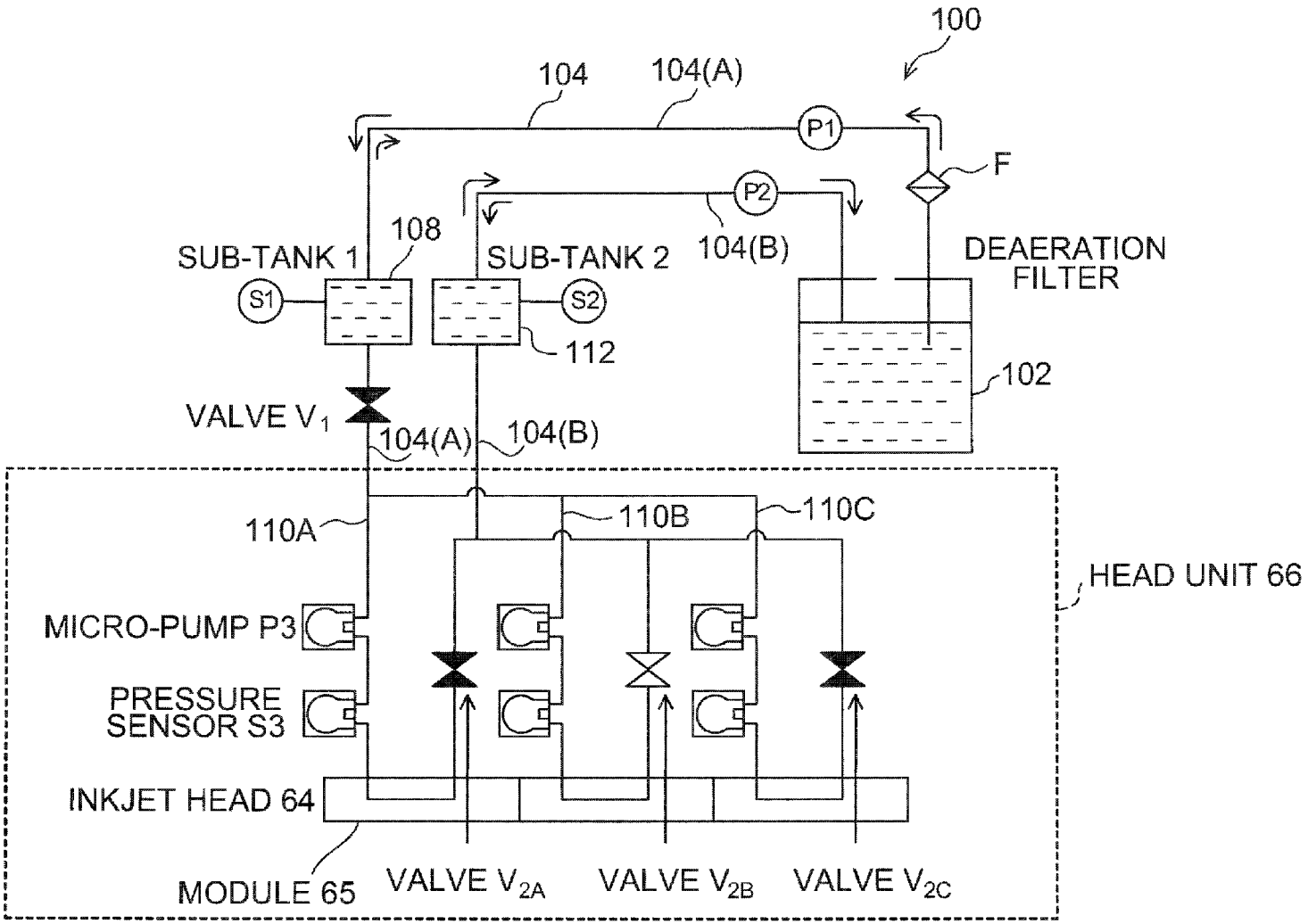
FIG. 2 is a schematic structural diagram illustrating schematics of an example of the droplet jetting device relating to the exemplary embodiment of the present invention.

Next, the droplet jetting device of the present exemplary embodiment will be described in detail. FIG. 2 shows a schematic structural diagram of an example of the droplet jetting device of the present exemplary embodiment.

The droplet jetting device 100 of the present exemplary embodiment has a structure that is provided with the head unit 66, a main tank 102, a circulation path 104, sub-tanks 108 and 112, and so forth. In the image forming device 10 of the present exemplary embodiment, this structure is provided in the number of types of ink provided (that is, four types, for the four colors YMCK in the present exemplary embodiment). In FIG. 2, only the structure for ink of one color (one type) is illustrated.

The main tank 102 is for storing ink to be supplied to the head unit 66, and is disposed at a position away from the head unit 66. In the image forming device 10 that forms images such that consumption amounts of ink are large, the main tank 102 is large. Accordingly, it is not preferable to dispose the large ink tank at the head unit 66, and therefore the main tank 102 is disposed at this separated position.

The circulation path 104 connects the head unit 66 with the main tank 102, via the sub-tanks 108 and 112, and is for circulating the ink. The circulation path 104 is formed with a circulation path 104A, which is an outward path from the main tank 102 to the head unit 66, and a circulation path 104B, which is a return path from the head unit 66 to the main tank 102. The circulation path 104 can be a tube and the like.

Ink in the main tank 102 is fed through the circulation path 104A by a tube pump P1 to the supply sub-tank 108 that is provided in the vicinity of the head unit 66. Ink that is not used in image formation is fed from the recovery sub-tank 112 through the circulation path 104B to the main tank 102 by a tube pump P2.

The sub-tank 108 stores the ink that has been fed thereto from the main tank 102 via the circulation path 104A, and supplies the ink to the head unit 66 through a valve unit V1 that performs on/off control of a flow path to the head unit 66. The valve unit V1 is for preventing the ink in the sub-tank 108 leaking out through the inkjet head 64 at times without electricity.

The sub-tank 112 stores ink that has been supplied to the head unit 66 and returned rather than being consumed by image formation, and is for returning the ink to the main tank 102. At the sub-tank 108 and the sub-tank 112, ink pressures in the tanks are detected by pressure sensors S1 and S2, control is performed to adjust the pressures to predetermined pressures, and ink circulation is implemented by a pressure difference between the sub-tank 108 and the sub-tank 112.

Ink circulation amounts vary depending on whether or not an image is being formed. The circulation flow paths in the head unit 66 are designed such that predetermined circulation is possible even at times of full jetting (when forming a solid image).

The head unit 66 is structured to include the inkjet head 64, which is constituted of the plural modules 65, a supply path 110 that supplies ink supplied from the sub-tank 108 to each module 65, a pressure sensor S3 that detects a pressure of ink supplied to each module 65, a micro-pump P3 and a valve V2. In FIG. 2, three of the modules 65 are illustrated, but this is not a limitation. There may be one or there may be even more. In addition, the single inkjet head 64 is illustrated but this is not limiting, and there may be plural inkjet heads 64. When carrying out high-throughput image formation, a structure that is provided with plural inkjet heads 64 is preferable. In FIG. 2, for the three modules 65, "A", "B" and "C", respectively, are appended to the reference numerals of the module 65, the supply path 110 and the valve unit V2. Where there is no need to individually describe each thereof, general reference will be made without applying the letters to the reference numerals.

The micro-pump P3 of the present exemplary embodiment is a piezo element that utilizes PZT thin film MEMS (micro-electromechanical systems) technology. The micro-pump P3 has the function of pressurizing ink supplied from the sub-tank 108 in a vicinity of the head.

Figure 3:
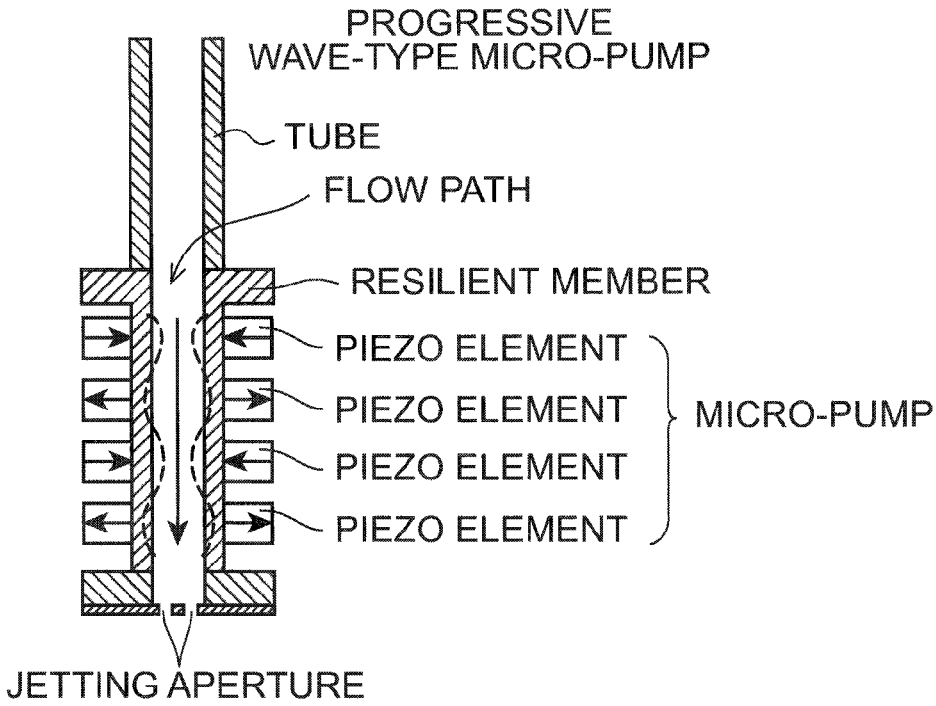
FIG. 3 is a sectional view illustrating an example of a progressive wave-type micro-pump that is applicable as a micro-pump relating to the exemplary embodiment of the present invention.
Figure 4:
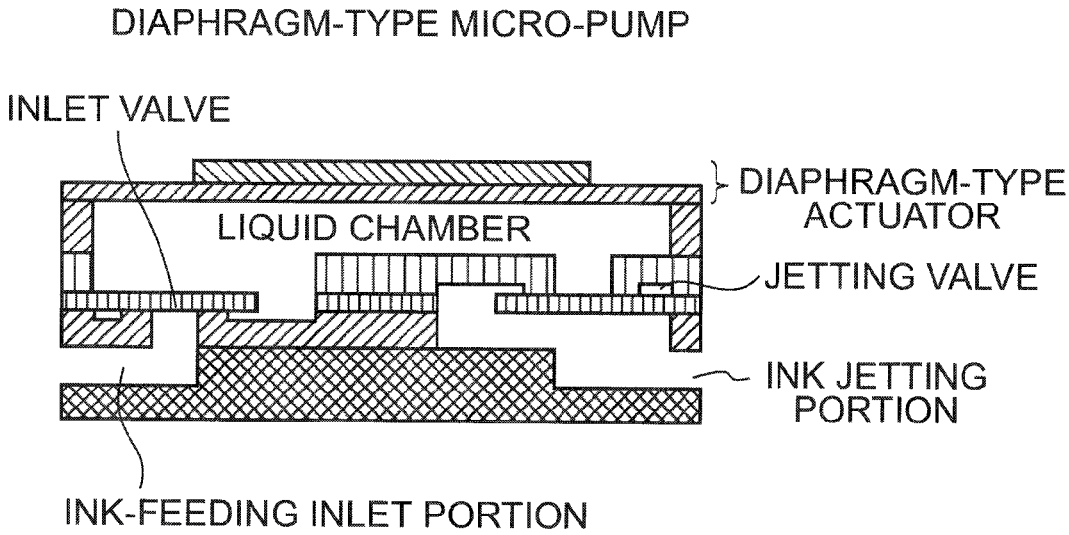
FIG. 4 is a sectional view illustrating an example of a diaphragm-type micro-pump that is applicable as a micro-pump relating to the exemplary embodiment of the present invention.

A progressive wave-type micro-pump with relatively small ripples is desirable as the micro-pump P3. A structure that drives plural diaphragm type micro-pumps in mutually different phases and suppresses pressure ripples in the liquid is also possible. For a progressive wave-type micro-pump, as an example, the progressive wave-type micro-pump illustrated in FIG. 3, which is described in Japanese Patent Application Laid-Open (JP-A) No. 2003-286958 is applicable. As a further example, the diaphragm-type micro-pump described in JP-A No. 2003-214349, which is illustrated in FIG. 4, is also applicable.

Because the micro-pump P3 is small in scale, it does not apply large pressures to the ink and there may be cases in which regulation of large changes in the pressure of the ink is difficult. However, in the present exemplary embodiment, the tube pumps P1 and P2 responding to the ink pressures of the sub-tanks 108 and 112 also adjust pressures of the ink whose pressure is regulated. Therefore, even in the cases mentioned above, problems will not arise.

Figure 5:
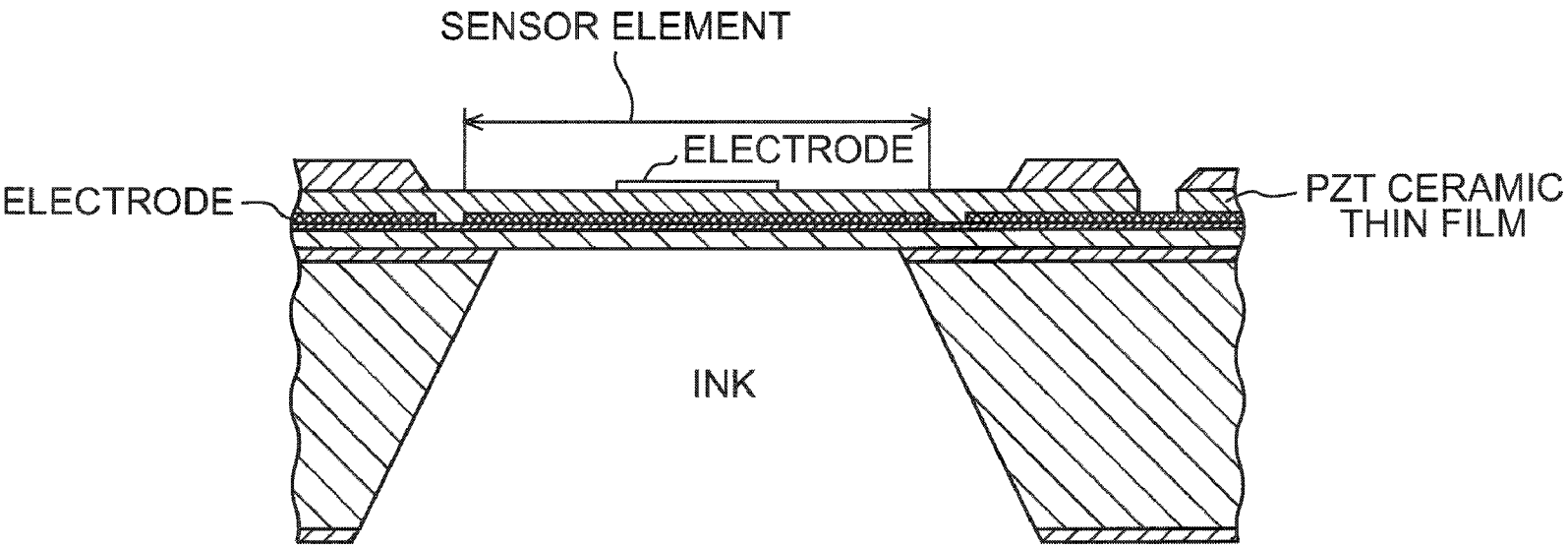
FIG. 5 is a sectional view of a micro-sensor illustrating an example of a diaphragm-type micro-sensor that is applicable as a pressure sensor relating to the exemplary embodiment of the present invention.

Similarly to the micro-pump P3, the pressure sensor S3 of the present exemplary embodiment is an element that utilizes PZT thin film MEMS technology. As an example, the diaphragm-type micro-sensor illustrated in FIG. 5, which is described in JP-A No. 2006-319945, or the like is applicable as the pressure sensor S3. The diaphragm type micro-sensor illustrated in FIG. 5 has a structure in which a surface at one side of a PZT thin film is in contact with the atmosphere (at atmospheric pressure), and a surface at the opposite side is in contact with the ink, through a film featuring electrical insulativity. When the pressure of the ink changes, the film shape of the PZT thin film is displaced and a voltage is generated. Therefore, pressures of the ink may be sensed by monitoring output voltages of the pressure sensor S3.

Figure 6:
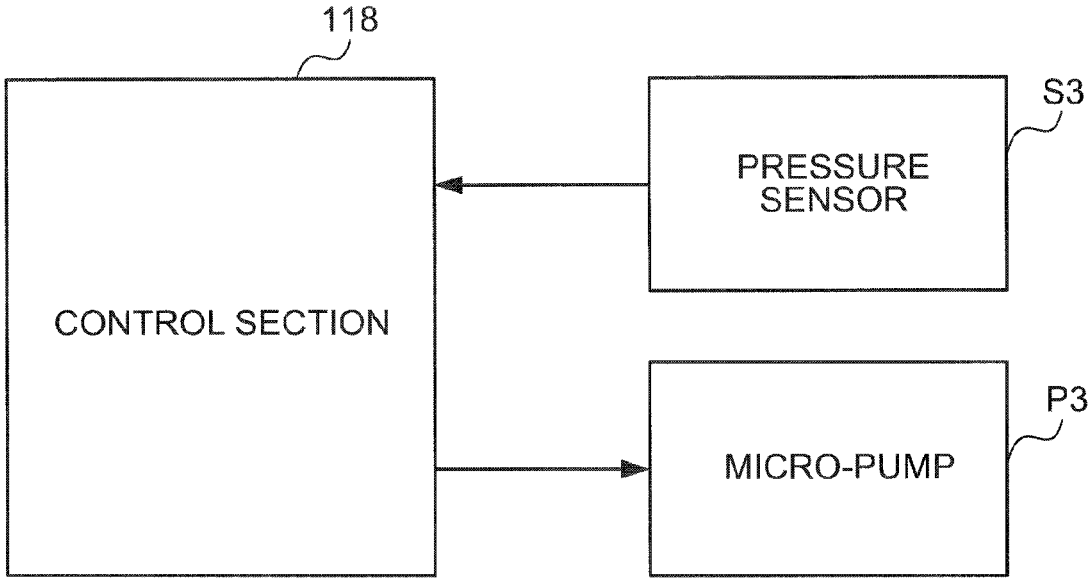
FIG. 6 is a functional block diagram illustrating schematics of an example of a structure relating to ink pressure control in the droplet jetting device relating to the exemplary embodiment of the present invention.

Pressure control of ink at the inkjet head 64 will be described with reference to FIG. 6. FIG. 6 is a functional block diagram of an example of a pressure control system of the head unit 66 relating to the exemplary embodiment of the present invention. Pressure of the ink flowing through the supply path 110 is sensed by the pressure sensor S3, and a control section 118 controls driving of the micro-pump P3 such that the pressure of the ink being supplied to the inkjet head 64 is constant. The micro-pump P3 pressurizes the ink flowing through the supply path 110 in accordance with control by the control section 118. As an example of the control section 118, a control circuit provided with a CPU or the like may be mentioned.

For a positional relationship between the micro-pump P3 and the pressure sensor S3, it is preferable to dispose the pressure sensor S3 closer to the inkjet head 64 than the micro-pump P3, as shown in FIG. 2. Hence, because the pressure sensor S3 is closer to the inkjet head 64, the pressure sensor S3 can sense pressure at a position closer to the nozzle face.

As described hereabove, the pressure sensor S3 of the present exemplary embodiment is an element that utilizes MEMS technology, and is small. Therefore, the pressure sensor S3 may be disposed close to the inkjet head 64 in the head unit 66. Thus, pressure of the ink at a position close to the nozzle face may be sensed.

Further, because the micro-pump P3 of the present exemplary embodiment is an element that utilizes MEMS technology and is small, the micro-pump P3 may be disposed in the vicinity of the inkjet head 64 and pressure sensor S3 in the head unit 66. Thus, accurate pressure control with good responsiveness may be implemented.

Figure 8:
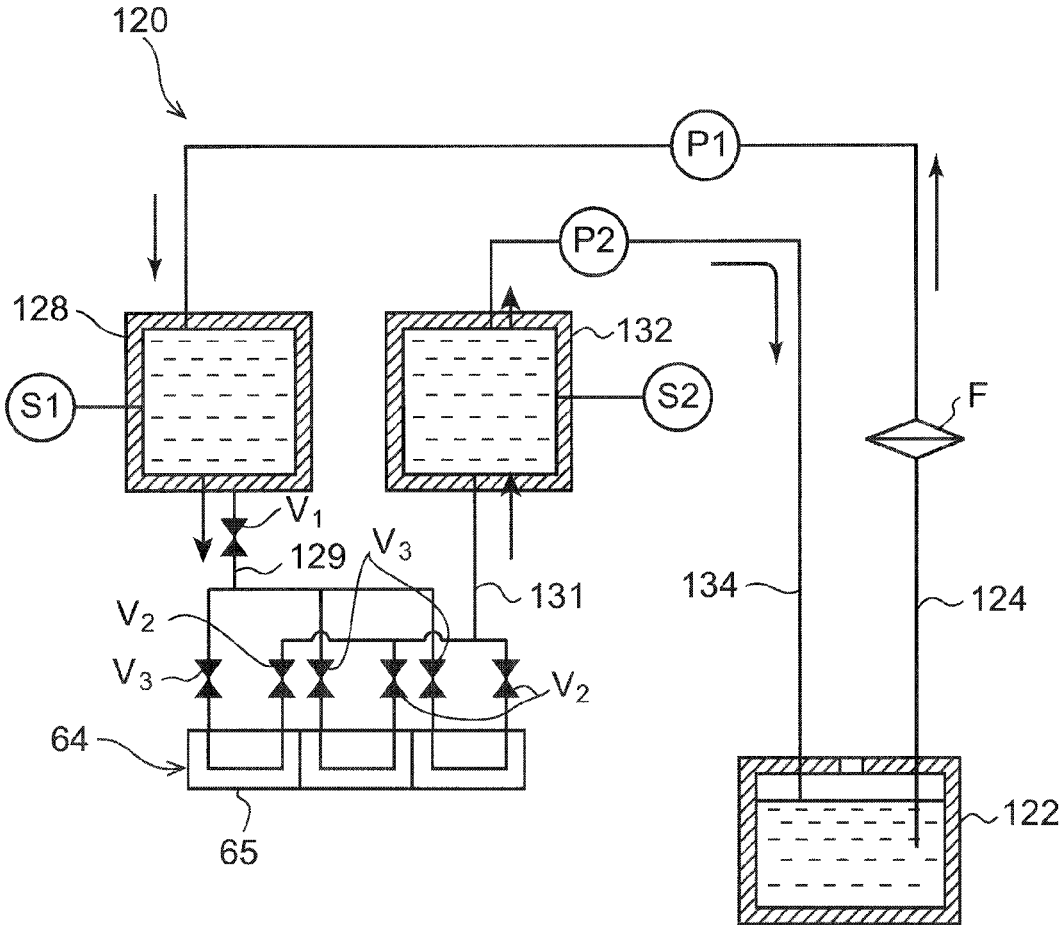
FIG. 8 RELATED ART
FIG. 8 is a schematic structural diagram illustrating schematics of an example of a related art droplet jetting device.

In a related art case (see FIG. 8), such that pressure at a supply-side pressure sensor S1 is constant, tube pumps P1 and P2 must be turned forward or turned backward in order to feed or extract ink through the tube pumps P1 and P2. To raise control responsiveness, switching of the direction of turning of the tube pumps P1 and P2 has to be performed instantaneously. However, instantaneously switching the turning direction puts great mechanical stresses on the tube pumps P1 and P2. As a result, the lifespans of the tube pumps P1 and P2 are shortened.

By contrast, in the present invention, because accurate pressure control may be performed with good responsiveness as described above, instantaneous switching of the turning directions from forward turning to rearward turning by the tube pumps P1 and P2 may be restrained. Therefore, stresses are less likely to be applied to the tube pumps P1 and P2, and shortening of the lifespans may be suppressed.

In the present exemplary embodiment, because the pressure sensor S3 and the micro-pump P3 are provided at each module 65, ink pressures may be more accurately controlled. Moreover, as a result, there is no need to provide the valve unit V2, which has been provided at the supply side in related art (see FIG. 8).

Figure 7:
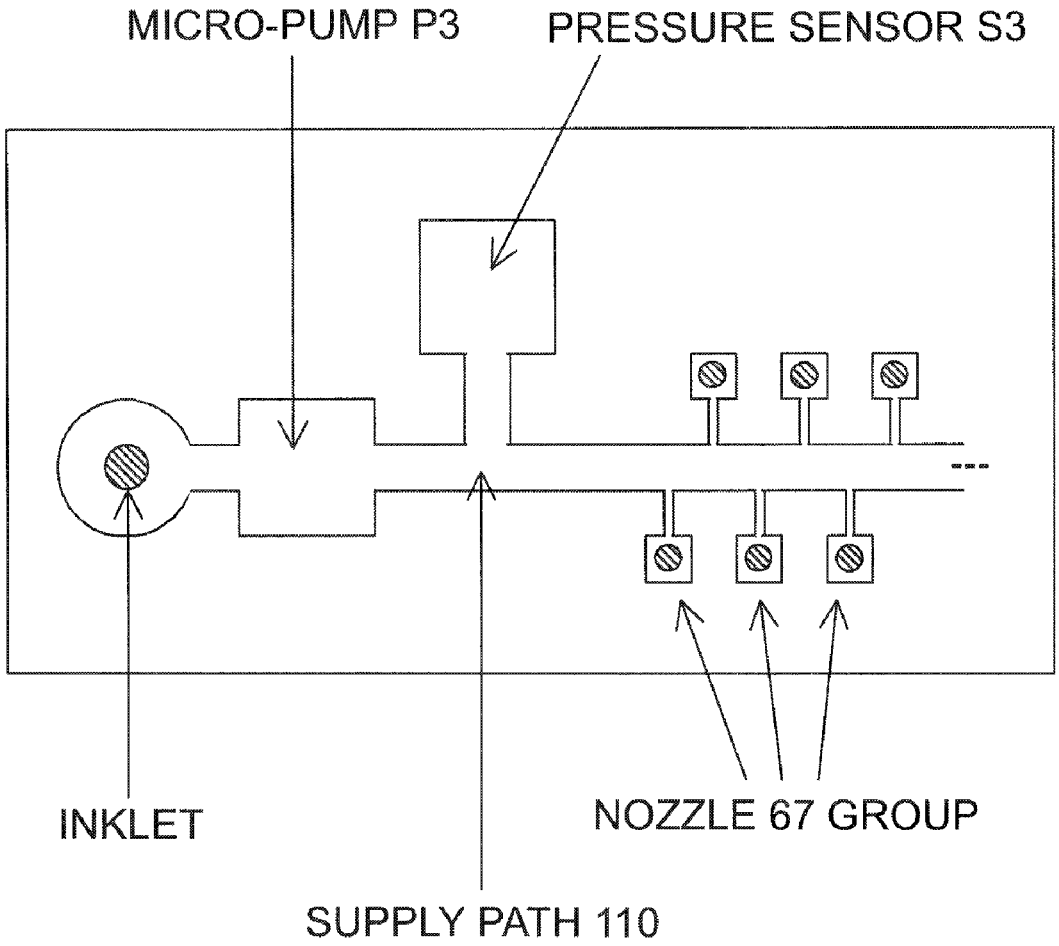
FIG. 7 is a conceptual diagram providing an overview of a die of an inkjet head when the inkjet head, micro-pump and pressure sensor relating to the present exemplary embodiment are similarly structured.

Hereabove, in FIG. 2, the inkjet head 64, micro-pump P3 and pressure sensor S3 being respectively separate structures has been illustrated, but this is not a limitation. In the present exemplary embodiment, piezoactuators that cause ink to be jetted from the nozzles provided in the inkjet head 64, the micro-pump P3 and the pressure sensor S3 are elements that use PZT thin films. Therefore, the micro-pump P3 and the pressure sensor S3 may be constituted using the same technology. A conceptual diagram giving an overview of a die of the inkjet head 64 is illustrated in FIG. 7 as an example in which they are the same structure. As illustrated in FIG. 7, for the present exemplary embodiment, the inkjet head 64, the micro-pump P3 and the pressure sensor S3 may be integrally formed on a single monolithic substrate by the same fabrication process.

Hence, increases and reductions in the width of images to be recorded (the number of the inkjet heads 64) may be handled smoothly.

In general, a driving circuit for driving the inkjet head 64 will often be disposed in the vicinity of the inkjet head 64. It is desirable to structure a circuit for driving the micro-pump P3 and a circuit for detecting voltages generated by the pressure sensor S3 (for example, the control section 118 of FIG. 6) integrally on the same electronic circuit board.

Accordingly, tiny voltages generated by the pressure sensor S3 may be accurately detected. Furthermore, by collecting control systems on each inkjet head 64, increases and reductions in the number of inkjet heads 64 may be handled smoothly.

One aspect of the present invention is a droplet jetting device including: a recording head section including a recording head that jets droplets from nozzles and records an image at a recording medium; a pressure sensor provided at the recording head section, the pressure sensor sensing a pressure of liquid supplied to the recording head by a main pump from a main tank, the main tank being disposed at a position away from the recording head section; and a regulation pump provided at the recording head section that is smaller in scale than the main pump, the regulation pump regulating pressure of the liquid such that the pressure of the liquid sensed by the pressure sensor is constant.

The recording head that jets droplets from the nozzles and records an image at a recording medium is provided at the recording head section. The liquid that is used for jetting the droplets is supplied by the main pump from the main tank that is disposed at a position separated from the recording head.

The pressure sensor is provided at the recording head section, and senses pressure of the liquid supplied by the main pump. The regulation pump is a pump that is smaller than the main pump, provided at the recording head section, and regulates pressure of the liquid such that the pressure of the liquid sensed by the pressure sensor is constant.

According to this droplet jetting device of the present invention, because the pressure sensor is provided at the recording head section, ink pressure in the vicinity of the recording head is measured. In addition, because the regulation pump is also provided at the recording head section, accurate pressure control with good responsiveness may be implemented.

In the droplet jetting device of the aspect described above, the recording head may be constituted by plural modules, the liquid may be supplied to the plural modules by supply paths provided to the respective modules, and, at each of the plural modules, the pressure sensor and the regulation pump may be provided on the supply path provided to the module.

The recording head section may be constituted by plural modules, the modules may be respectively provided at supply paths supplying the liquid, and the pressure sensors and regulation pumps may be provided on the respective supply paths.

Thus, by providing the pressure sensor and regulation pump at each module, accurate pressure control with even better responsiveness may be implemented.

In the droplet jetting device of the aspects described above, the regulation pump and the pressure sensor may each include a piezo element.

As a result of the regulation pump and pressure sensor being thus constituted as MEMS elements which are suitable for miniaturization, the regulation pump and pressure sensor may be disposed closer to the recording head.

In the droplet jetting device of the aspects described above, the regulation pump and the pressure sensor may each include a piezo element.

As a result of the regulation pump and pressure sensor being thus constituted to respectively include piezo elements, further miniaturization and higher efficiency are possible.

In the droplet jetting device of the aspects described above, the recording head may include piezoelectric elements that cause droplets to be jetted from the nozzles, and the recording head, the pressure sensor and the regulation pump may be formed integrally.

The recording head may be constituted to include piezo elements that cause droplets to be jetted from the nozzles. Thus, in accordance with the recording head, the regulation pump and the pressure sensor being respectively constituted to include these elements, the same may be formed integrally. Hence, formation is simpler, and changes in numbers of recording heads and the like may be dealt with smoothly.

In the droplet jetting device of the aspects described above, the pressure sensor may be provided between the regulation pump and the recording head.

The pressure sensor may be disposed between the regulation pump and the recording head. Thus, the pressure sensor may be disposed closer to the recording head. Therefore, ink pressure closer to the recording head is measured.

The droplet jetting device of the aspect described above may include a sub-tank provided between the main tank and the recording head section, the sub-tank storing liquid to be supplied to the recording head section, and the main pump may supply the liquid such that a pressure in the sub-tank is constant.

The sub-tank that stores the liquid to be supplied to the recording head section is disposed between the main tank and the recording head section, and the main pump supplies the liquid such that pressure in the sub-tank is constant.

Thus, pressure control in response to large variations in pressure of the liquid, which are difficult to handle with, for example, just the pressure sensor and the regulation pump, is performed with ease.

The droplet jetting device of the aspects described above may further include a liquid circulation component that causes the liquid to circulate between the main tank and the recording head section.

A circulation component that causes the liquid to circulate between the main pump and the recording head section may be provided.

According to the droplet jetting device of the present invention, ink pressure in the vicinity of a recording head is measured and a pump is disposed in the vicinity of the recording head, and accurate pressure control with good responsiveness may be performed.

What is claimed is:

1. A droplet jetting device comprising:

a recording head section including a recording head that jets droplets from nozzles and records an image at a recording medium;

a pressure sensor provided at the recording head section, the pressure sensor sensing a pressure of liquid supplied to the recording head by a main pump from a main tank, the main tank being disposed at a position away from the recording head section; and a regulation pump provided at the recording head section that is smaller in scale than the main pump, the regulation pump regulating pressure of the liquid such that the pressure of the liquid sensed by the pressure sensor is constant.

2. The droplet jetting device of claim 1, wherein the recording head is constituted by a plurality of modules, the liquid is supplied to the plurality of modules by supply paths provided to the respective modules, and, at each of the plurality of modules, the pressure sensor and the regulation pump are provided on the supply path provided to the module.

3. The droplet jetting device of claim 1, wherein the regulation pump and the pressure sensor each includes a MEMS element.

4. The droplet jetting device of claim 1, wherein the regulation pump and the pressure sensor each includes a piezo element.

5. The droplet jetting device of claim 4, wherein the recording head includes piezoelectric elements that cause droplets to be jetted from the nozzles, and the recording head, the pressure sensor and the regulation pump are formed integrally.

6. The droplet jetting device of claim 1, wherein the pressure sensor is provided between the regulation pump and the recording head.

7. The droplet jetting device of claim 1, further comprising a sub-tank provided between the main tank and the recording head section, the sub-tank storing liquid to be supplied to the recording head section, wherein the main pump supplies the liquid such that a pressure in the sub-tank is constant.

8. The droplet jetting device of claim 1, further comprising a liquid circulation component that causes the liquid to circulate between the main tank and the recording head section.

9. The droplet jetting device of claim 1, wherein the regulation pump comprises a progressive wave-type micro-pump.

10. The droplet jetting device of claim 1, wherein the regulation pump comprises a diaphragm-type micro-pump.

* * * * *